United States Patent [19]

Ciprandi

[11] Patent Number: 4,866,956

[45] Date of Patent: Sep. 19, 1989

[54] MOTORIZED BELT SQUEEZING EQUIPMENT FOR THE TREATMENT OF WET FABRICS, TAPES, KNITTED GOODS AND SIMILAR

[75] Inventor: Riccardo Ciprandi, Bergamo, Italy

[73] Assignee: Ciprandi S.n.c. di Ciprandi Riccardo & C., Bergamo, Italy

[21] Appl. No.: 258,216

[22] Filed: Oct. 14, 1988

[51] Int. Cl.[4] ..... D06B 3/12

[52] U.S. Cl. ..... 68/22R; 68/44; 68/180; 100/153

[58] Field of Search ..... 68/22 R, 44, 45, 180; 100/153

[56] References Cited

U.S. PATENT DOCUMENTS

| | | | |
|---|---|---|---|
| 273,078 | 2/1883 | Higgins et al. | 68/44 |
| 2,430,868 | 11/1947 | Francis, Jr. | 100/153 X |
| 3,643,474 | 2/1972 | Schiffer | 68/180 X |
| 3,643,475 | 2/1972 | Stevens, Jr. | 68/44 X |
| 3,802,838 | 4/1974 | De La Serviere | 68/44 X |
| 3,806,405 | 4/1974 | Heidweller | 68/44 |

*Primary Examiner*—Frankie L. Stinson
*Attorney, Agent, or Firm*—Ladas & Parry

[57] ABSTRACT

This equipment for the wet treatment of fabrics, tapes, knitted goods and similar consists of a closed loop motorized belt which is pressed onto the fabric, tape, knitted goods or similar. It is wound over the top of rollers, which are not in the bath, to encourage its sliding action and enable cyclic immersion in and emergence from the treatment liquids to be carried out. Other transmission rollers are immersed in the treatment liquids, passed through and rotated by the above fabric which can then slide, wind onto and unwind from end bobbins according to pre-established cycles. The bobbins are also placed in direct contact with the motorized belt by means of appropriate thrust devices.

10 Claims, 1 Drawing Sheet

MOTORIZED BELT SQUEEZING EQUIPMENT FOR THE TREATMENT OF WET FABRICS, TAPES, KNITTED GOODS AND SIMILAR

DESCRIPTION

This invention applies to the field of equipment for the wet treatment of fabrics, tapes, knitted goods and similar, for use in dyeing type operations, scouring, fulling, bleaching, washing, decatizing, in particular for treatment of goods in motion.

As is known, many of the treatments to which fabrics, tapes and similar goods are subjected are in fact wet treatments, i.e. carried out under conditions where the goods are exposed to the action of liquids or steam. For these treatments widely differing types of equipment are normally used in an attempt to obtain optimum results.

They generally operate with the goods either wrapped round bobbins and subject to cyclic rolling and unrolling, or with the goods looped or in a rope. Another feature of the operating methods of these machines is the fact that they use a relatively slow moving or circulating bath.

Each of these pieces of equipment operates efficiently for specific operational methods, but this operational efficiency is not usually sufficiently versatile to cope with different types of fabrics or tapes, and the operational methods are restricted to those specifically required by the cycle, which involves considerable running costs.

The aim of this invention is to produce a piece of equipment which is equally suitable for the wet treatment of fabrics, tapes, knitted goods and similar.

A further aim is to produce a piece of equipment which will perform several operations typical of the textile sector such as dyeing, scouring, fulling, bleaching, washing and decatizing.

A further aim is to produce a piece of equipment which does not require the use of special bobbins but will in fact use the same truck-mounted bobbins normally used for transport and storage purposes.

A further aim was to produce a piece of equipment which would carry out the required operations with considerable rapidity.

A further aim was to produce a piece of equipment which would give exposure of large surface areas of the fabric, which is particularly useful where exchange of the overhead ambient (steam) is required.

A further aim was to avoid the use of differential devices on the equipment to stabilize the sliding speed of the fabric which would otherwise vary according to the diameter of the bobbins when these are of the driving type.

A further aim was to produce a piece of equipment which would enable adjustment of the retention rate of the bath to be carried out using means intrinsic to its operation.

A further aim was to use diluted, and therefore economical, baths which would still achieve excellent results by leaving the goods in contact with the liquids for longer periods of time.

These and other aims would appear to be achieved as can be seen from a reading of the detailed description which follows, illustrating a piece of equipment for the wet tretment of fabrics, tapes, knitted goods and similar. This equipment is characterized by a closed loop motorized belt which is pressed on to the fabric, tape, knitted goods or similar to be treated. These are wound over rollers, which are not in the bath, in order to ensure both squeezing and sliding and, at the same time, obtain cyclic immersion in and emergence from the treatment liquids. These treatment liquids can be motionless or in counter-current flow in tanks positioned beneath, in which other transmission rollers are immersed, passed through and rotated by the fabric which can then slide, wind onto and unwind from terminal bobbins according to pre-established cycles. The bobbins are also placed in direct contact with the motorized belt by means of appropriate thrust devices.

The invention is illustrated by way of example and in no sense restrictively in the enclosed drawing where:

FIG. 2 shows a cross-section of a motorized belt fixed with its own protrusions on coupled grooves of a roller which is shown in part on the drawing.

Figure 1:
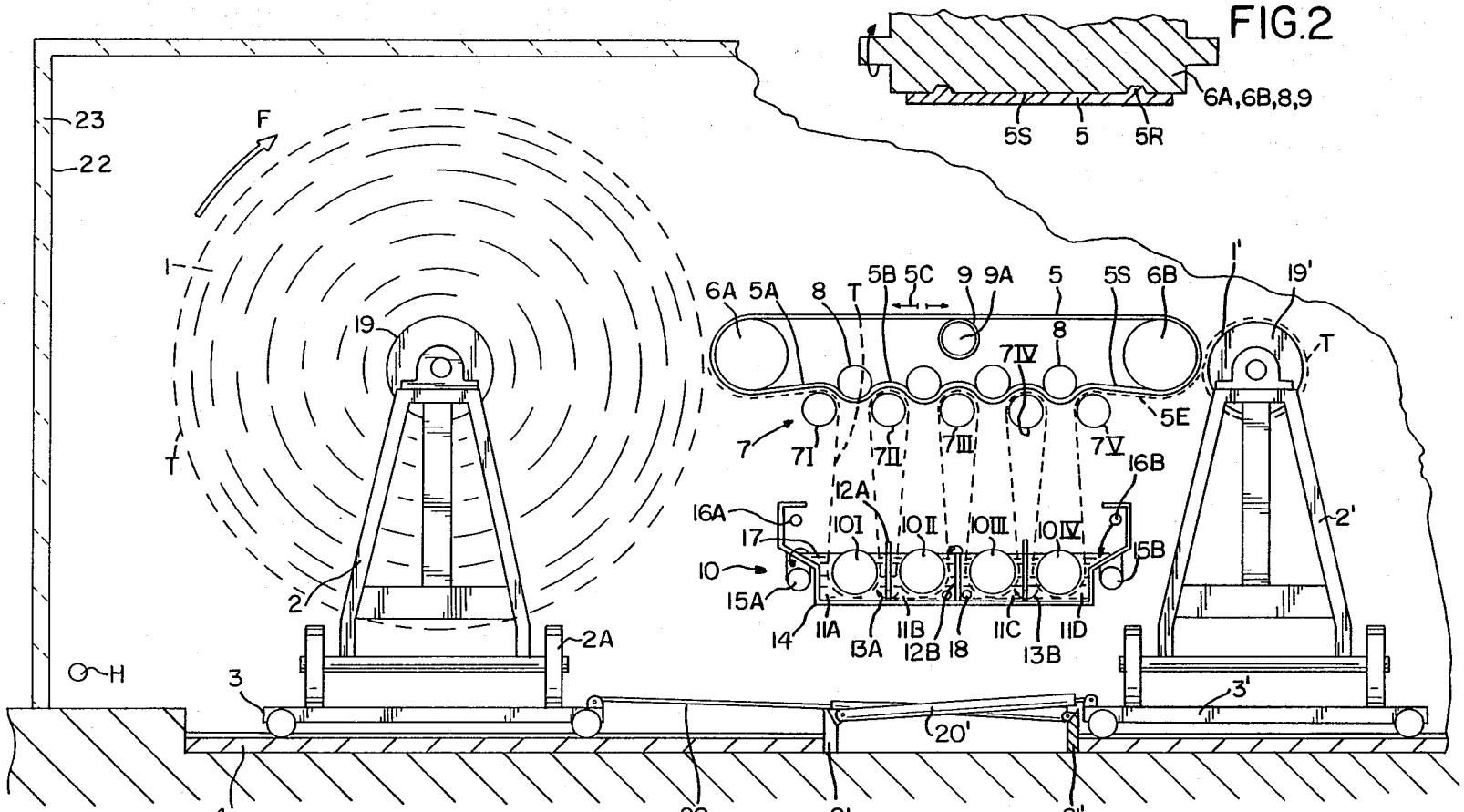
FIG. 1 shows a longitudinal diagram of a version of the invention.

FIG. 1 shows how the equipment has a number of characteristics which are only normally found on several different machines: in fact it has the advantage of using bobbins like those on Jigger type machines. Added to this is the favourable feature (typical of Foulard equipment) of using low bath ratios, plus the favourable characteristic of counter-current flow of the bath, typical of the winch beck equipment generally used for rope fabrics.

Operation of the equipment is specified with reference to the above-mentioned figures. A bobbin 1 of fabric or similar is supported by a normal stand 2 resting on its truck 3, which slides on rails 4 perpendicularly to the direction in which stand 2 is allowed to slide by means of its wheels 2A.

In an intermediate position, rubber belt 5, reinforced using the usual techniques employed for conveyor belts (or flat transportation belts) gives the movement of the fabric as outlined here. Belt 5 is supported by two cylinders 6A and 6B on parallel axes and at the least one of these performs a driving action. The lower part 5A of belt 5 is guided along an undulating course 5B by means of rollers 7 and 8 with axes parallel to cylinders 6A and 6B. The straightening tension with which the length 5B presses on rollers 7 and 8 is supplied by a specific tension roller 9 acting on another length of belt 5; i.e. it performs its action in an intermediate position between cylinders 6A and 6B. Roller 9 has the normal end supports (not included in the drawing) which move independently in a vertical direction; their action is brought about by the usual special screw and nut-screw pairs whereby the different threading determines the oblique position of axis 9A on the vertical plane perpendicular to the direction in which belt 5 travels. This slight obliqueness creates lateral tensions on belt 5 which create axial factors (i.e. transversally to its movement) which are able to compensate for the presence of any other axial factors caused by kinematics. As an auxiliary or alternative guiding element to the asymmetrical tightening action (compensating for the transverse factors in the movement of belt 5), a coupling solution is used between the cylinders or rollers 6A, 6B, 8 and 9 and the internal surface 5S of the belt, consisting of a triangular or trapezoidal section protrusion 5R (located on surface 5S of belt 5) coupled with the grooves on rollers 6A, 6B, 8 and 9 (FIG. 2). These rollers or cylinders therefore behave like trapezoidal race pulleys in relation to a trapezoidal belt used with them.

Below rollers 8 there are the same number of rollers 10, which are more or less immersed in the treatment liquid (e.g. dye bath). This immersion should preferably be carried out in special extended tanks 11A, 11B, 11C and 11D.

These tanks are separated from each other by partitions 12A, 12B and 12C positioned in series: one high partition 12A is drilled at the bottom at 13A and alternates with a subsequent low partition 12B which is not drilled at the bottom. The whole of tank 14 is served by pairs of apertures for the inflow 15A and 15B and outflow 16A and 16B of liquid 17, together with holes 18 which serve for complete discharge of the liquid contained in it. These pairs of apertures operate alternately as they are located on the right and left respectively (looking at the drawing) to give a direction of flow of the liquid to either the left or right. For instance, if a flow of liquid is requied from right to left, inflow aperture 16B is opened and and, at the same time, the outflow aperture 16A is closed. The outflow aperture 15B is closed and the other outflow aperture 15A opens. Liquid 17 thus flows out of aperture 6B, into the extended tank 11D; it passes through the different holes 13B on the bottom of partition 12C to reach extended tank 11C. Here it is forced upwards to the top edge of partition 12B, and overflows into the next extended tank 11B. This tank is in turn in communication with the adjacent extended tank 11A by means of holes 13A located at the bottom.

From extended tank 11A, liquid 17 is forced to rise to a certain overflow level from which it flows into the outflow aperture 15A. Inverting opening of apertures 15A, 15B, 16A and 16B, it is obvious that the flow is inverted. Movement of the flow is naturally obtained with use of a normal external pump. The direction of flow, i.e. activation of the different valves leading to the above-mentioned apertures 15 and 16, is linked to the sliding direction of belt 5, so that it is always the contrary of the movement which a fabric T undergoes during treatment owing to the effect of the belt. This description of the essential parts should give a clear understanding of how the equipment operates.

The end of the fabric or similar T, wound as bobbin 1, is passed manually below the length of belt 5 beneath cylinder 6A. T is then passed over roller 7I and it drops into tank 11A, wrapping round the smooth roller 10I. It next moves upwards and is inserted between belt 5 and roller 7II. After transit on this roller, the fabric or similar T again moves downwards for immersion in tank 11B and wraps round the transmission roller 10II.

In this way the fabric proceeds through the series of immersions in tanks 11A, 11B, 11C . . . and is squeezed through rollers 7I, 7II, 7III . . . 7 and belt 5, alternating between the two series of top rollers (7) and bottom rollers 10 (10I, 10II, 10III . . . ).

The end of fabric T mentioned above, or any length of the fabric, thus reaches the last top roller or squeezer 7V and it then proceeds towards cylinder 6B positioned on the bottom external side 5E of belt 5, to then wind round the bobbin on idle roller 19' of stand 2'. Assuming a clockwise direction of rotation for bobbin 1 (on the left of the drawing), as indicated by arrow f, the fabric which would in this way unwind because of the friction exerted on it by belt 5, would pull bobbin 1 to the right until it came into direct contact with belt 5 flexed by cylinder 6A. The same advantageous effect would not, however, be achieved on the other bobbin 1' which would temporarily be picking up the fabric.

To remedy this, stands 2 and 2' supporting bobbins 1 and 1' are mounted on trucks 3 and 3' which are pulled towards each other by special devices such as, for instance, pneumatic pistons.

An example of application of these pistons is given in the drawing with pistons 20 and 20'. They are both independent and connected to fixed structures 21 and 21' of the machine.

This example is intended purely for indicative purposes, as the same result of keeping the two bobbins 1 and 1' pressed against belt 5 flexed by the two cylinders 6A and 6B can be achieved even with just one pneumatic piston, shorter than those indicatd and anchored with its two ends directly to the two trucks 3 and 3'. The same solution of direct fixture of the two trucks can be achieved using normal traction springs. These may be used with the usual screw stays for adjustment of the distance between attachments and for adjustment of their traction force, which should be considered as virtually constant. In fact reduction of the diameter of a bobbin gives a simultaneous increase in the diameter of the other bobbin, so that the distance between the bobbins is practically always the same since they are subject to translation in the same direction.

The equipment operates cyclically in that once the fabric has been transferred from one bobbin (1) to the other (1'), the movement is reversed so you again have transfer from one bobbin (1') to the other (1).

Normal type senors are located on the bobbin to check this, or electronic programmers can be used based on a certain number of rotations of a certain roller, preset to give unwinding of the desired length of fabric.

The fabric can thus pass alternately from one bobbin (1) to another (1') and vice versa innumerable times, in fact until such time as the desired impregnation of liquid 17 is achieved, i.e. until completion of whatever wet treatment is required. It should, in fact, also be noted that the whole equipment is placed inside a completely enclosed housing 22 which is fitted with heat insulation 23. It is also tightly sealed to ensure maintenance of steam conditions inside. Steam is injected through apertures H at the usual temperatures used in treatments for which this equipment is designed.

I claim:

1. Apparatus for wet treatment of fabrics, and/or other materials, the apparatus comprising:

a closed loop belt having an inner surface and an outer surface;

a plurality of primary rollers disposed against the outer surface of the belt;

a plurality of secondary rollers disposed against the inner surface of the belt and juxtaposed with the primary rollers, a portion of the belt being positioned between the primary and the secondary rollers;

a plurality of tanks to contain liquid, the tanks being spaced from and associated with the rollers;

a plurality of transmission rollers, one transmission roller being located in each tank, each transmission roller in use guiding material through a tank;

a bobbin located adjacent each end of the belt, one bobbin dispensing fabric to be treated, the other bobbin taking up the treated fabric;

thrusting means to urge the bobbins toward the belt;

a tension roller urged against the belt, the tension roller being movably mounted to permit adjusting of the tension on the belt; and wherein in use fabric is taken from the dispensing bobbin, passes through at least some of the primary, secondary and transmission rollers, through the tank and thereafter to the take-up bobbin.

2. Apparatus as claimed in claim 1 further comprising end rollers, the closed loop belt being mounted upon the end rollers.

3. Apparatus as claimed in claim 1 wherein:

the belt has protrusions on its inner surface; and the end rollers, the primary rollers, the secondary rollers and the tension roller have corresponding grooves to register with the protrusions to guide the belt as it moves.

4. Apparatus as claimed in claim 1 further comprising stands on which the bobbins are rotatably supported.

5. Apparatus as claimed in claim 4 further comprising trucks upon which the stands are placed.

6. Apparatus as claimed in claim 5 further comprising rails upon which the trucks are mounted.

7. Apparatus as claimed in claim 5 wherein the thrusting means comprise pneumatic pistons, one end of the pneumatic pistons connected to the trucks and the other end thereof attached to a fixed structure.

8. Apparatus as claimed in claim 5 wherein the thrusting means comprise pneumatic pistons, one end of the pneumatic pistons is attached to one of the trucks and the other end of the pneumatic pistons is attached to the other of the trucks.

9. Apparatus as claimed in claim 5 wherein the thrusting means comprise at least one adjustably disposed traction spring connecting the trucks.

10. Apparatus for wet treatment of fabrics and/or other materials, the apparatus comprising:

a closed loop belt having an inner surface and an outer surface;

a plurality of primary rollers disposed against the outer surface of the belt;

a plurality of secondary rollers diposed against the inner surface of the belt and juxtaposed with the primary rollers, a portion of the belt being positioned between the primary and the secondary rollers;

a tank spaced from and associated with the rollers, the tank having alternately high and low partitions, outflow apertures and inflow apertures, the high and low partitions and the outflow and inflow apertures being adjustable to permit a flow of a liquid in either direction;

a plurality of transmission rollers disposed in the tank, the transmission rollers guiding the material through the tank;

a bobbin adjacent to each end of the belt, one bobbin dispensing fabric to be treated, the other bobbin taking up the treated fabric;

thrusting means to urge the bobbins toward the belt;

a tension roller urged against the belt, the tension roller movably mounted to permit adjusting of the tension of the belt;

wherein in use fabric is taken from the dispensing bobbin, passes through at least some of the primary, secondary and transmission rollers through the tank and thereafter to the take-up bobbin.

* * * * *